US005472124A

United States Patent [19]

Martushev

[11] Patent Number: 5,472,124

[45] Date of Patent: Dec. 5, 1995

[54] SMALL ENGINE FLUID DISPENSING CONTAINERS

[76] Inventor: Nikolai K. Martushev, P.O. Box 2661, Homer, Ak. 99603

[21] Appl. No.: 269,019

[22] Filed: Jun. 30, 1994

[51] Int. Cl.[6] ..... B67D 3/00

[52] U.S. Cl. ..... 222/529; 222/530

[58] Field of Search ..... 222/482, 465.1, 222/525, 528, 529, 530, 331, 568; 141/301, 338

[56] References Cited

U.S. PATENT DOCUMENTS

| | | | |
|---|---|---|---|
| 1,377,923 | 5/1921 | Posa | 222/331 |
| 2,516,728 | 7/1950 | Smith | 222/465.1 |
| 2,552,155 | 5/1951 | Danielson | 222/525 |
| 4,416,396 | 11/1983 | Ward | 222/530 |
| 4,781,314 | 11/1988 | Schoonover et al. | 222/465.1 |
| 4,972,972 | 11/1990 | Goguen | 222/530 |
| 5,244,021 | 9/1993 | Hau | 222/530 |

*Primary Examiner*—Andres Kashnikow
*Assistant Examiner*—Philippe Derakshani

[57] ABSTRACT

A small engine fluid dispensing container comprises a container formed as a hollow generally rectangular shaped box with a top wall, a bottom wall, and side walls. The top wall includes a circular aperture with a neck extending upwardly from its circumfrential edges. A cap includes a coupling device and is positioned on top of the neck in the inoperative orientation. One of the side walls includes a self sealing spout for controlled dispensing of fluid.

6 Claims, 4 Drawing Sheets

SMALL ENGINE FLUID DISPENSING CONTAINERS

BACKGROUND OF THE INVENTION

1. Field of the Invention

The present invention relates to small engine fluid dispensing containers and more particularly pertains to dispensing controlled quantities of fluid into the tanks of small engines from one of a plurality of sources.

2. Description of the Prior Art

The use of liquid containers and dispensers is known in the prior art. More specifically, liquid containers and dispensers heretofore devised and utilized for the purpose of containing and dispensing liquids are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,927,797 to Flider a plastic jerry can.

U.S. Pat. No. 4,095,726 to Hechler discloses a portable supply tank.

U. S. Pat. No. 4,781,314 to Schoonover discloses a fluid container.

U.S. Pat. No. 4,923,098 to Schoonover discloses a fluid container.

Lastly, U.S. Pat. No. 5,056,691 to Tolbert discloses a valved fuel dispensing container.

In this respect, the small engine fluid dispensing containers according to the present invention substantially depart from the conventional concepts and designs of the prior art, and in doing so provides an apparatus primarily developed for the purpose of dispensing controlled quantities of fluid into the tanks of small engines from one of a plurality of sources.

Therefore, it can be appreciated that there exists a continuing need for new and improved small engine fluid dispensing containers which can be used for dispensing controlled quantities of fluid into the tanks of small engines from one of a plurality of sources. In this regard, the present invention substantially fulfills this need.

SUMMARY OF THE INVENTION

In view of the foregoing disadvantages inherent in the known types of liquid containers and dispensers now present in the prior art, the present invention provides an improved small engine fluid dispensing container. As such, the general purpose of the present invention, which will be described subsequently in greater detail, is to provide a new and improved small engine fluid dispensing container and method which has all the advantages of the prior art and none of the disadvantages.

To attain this, the present invention essentially comprises a new and improved small engine fluid dispensing container including a container fabricated of plastic and formed as a hollow generally rectangular shaped box. The container has a top wall, a bottom wall, a narrow front wall, a narrow back wall, and parallel wide side walls. All of the corners and edges of the container are rounded. The container includes an inverted L-shaped recessed indentation at the intersection of the front wall and bottom wall. The vertical portion of the indentation includes a centrally located circular hole near the bottom wall. The central portion of the large side walls of the container include generally rectangular shaped indentations to add strength to the apparatus. The top wall includes a centrally positioned circular aperture near the intersection of the front and top walls. The aperture has a neck which extends upwardly from its circumfrential edges. The neck is formed in a generally cylindrical configuration and includes external screw threads near its upper extent. A circular ring and spout are included in the apparatus. The ring is positioned around the periphery of the hole in the container. The ring extends outwardly and includes external screw threads. The interior of the hole includes a small centrally located aperture. The interior of the hole has a slightly larger circumference than the circular opening in the ring. The spout is formed in a generally tubular configuration with an inner region, an outer region and a middle region therebetween. The inner and outer regions have openings at both ends. The inner region has a larger circumference than the other regions and is adapted to be positioned in the interior of the hole. The outer region is angled upward and extends outside the hole. The middle region connects the inner and outer regions and is positioned within the opening in the ring. The open end of the inner region has a circular planar plate positioned within it. The plate includes a plurality of circular holes near its perimeter. The apparatus is adapted to allow the free flow of fluid therethrough when pulled outward by the user. When pushed inward, the inner portion of the plate is thrust flush against the small aperture in the hole thereby preventing the flow of fluid. A fill cap and an associated valve are included in the apparatus. The fill cap is formed in a generally cylindrical configuration with an open bottom which includes a plurality of internal screw threads. The top is formed in a planar configuration with a centrally located hollow tube extending upward therefrom. The top includes a hole below the hollow interior of the tube. The cap is adapted to be releasably coupled to the neck in the operative orientation. The valve includes a tubular component with two open ends. The valve also includes a regulator component with a round planar end located within the tubular component. The regulator component has a generally triangular shaped handle with rounded ends which is located outside of the tube. A thin axle connects the round planar end and handle therebetween. The valve is adapted to regulate the flow of fluid therethrough upon turning of the handle by the user. The valve is adapted to be positioned within the tube of the filler cap in the operative orientation. A hose is formed in a hollow tubular configuration with two open ends. In one orientation, an end of the hose in coupled with the free end of the valve and the other end is positionable in the tank of a small engine. In another orientation, an end of the hose is coupled with the free end of the spout and the other end is positionable in the tank of a small engine. Both free ends of the hose are coupled with the valve assembly and spout in the inoperative orientation. A handle has one end which extends upwardly a short distance from the top wall of the container. The other end of the handle is formed contiguously with the rounded intersection of the top and back walls. The remainder of the handle is positioned in an angled orientation therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved small engine fluid dispensing containers which have all the advantages of the prior art liquid containers and dispensers and none of the disadvantages.

It is another object of the present invention to provide new and improved small engine fluid dispensing containers which may be easily and efficiently manufactured and marketed.

It is further object of the present invention to provide new and improved small engine fluid dispensing containers which are of durable and reliable constructions.

An even further object of the present invention is to provide new and improved small engine fluid dispensing containers which are susceptible of a low cost of manufacture with regard to both materials and labor, and which accordingly are then susceptible of low prices of sale to the consuming public, thereby making such small engine fluid dispensing containers economically available to the buying public.

Still yet another object of the present invention is to provide new and improved small engine fluid dispensing containers which provide in the apparatuses and methods of the prior art some of the advantages thereof, while simultaneously overcoming some of the disadvantages normally associated therewith.

Still another object of the present invention is to dispense controlled quantities of fluid into the tanks of small engines from one of a plurality of sources.

Lastly, it is an object of the present invention to provide new and improved small engine fluid dispensing containers comprising a container formed as a hollow generally rectangular shaped box with a top wall, a bottom wall, and side walls. The top wall includes a circular aperture with a neck extending upwardly from its circumfrential edges. A cap includes a coupling device and is positioned on top of the neck in the operative orientation. One of the side walls includes a self sealing spout for controlled dispensing of fluid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
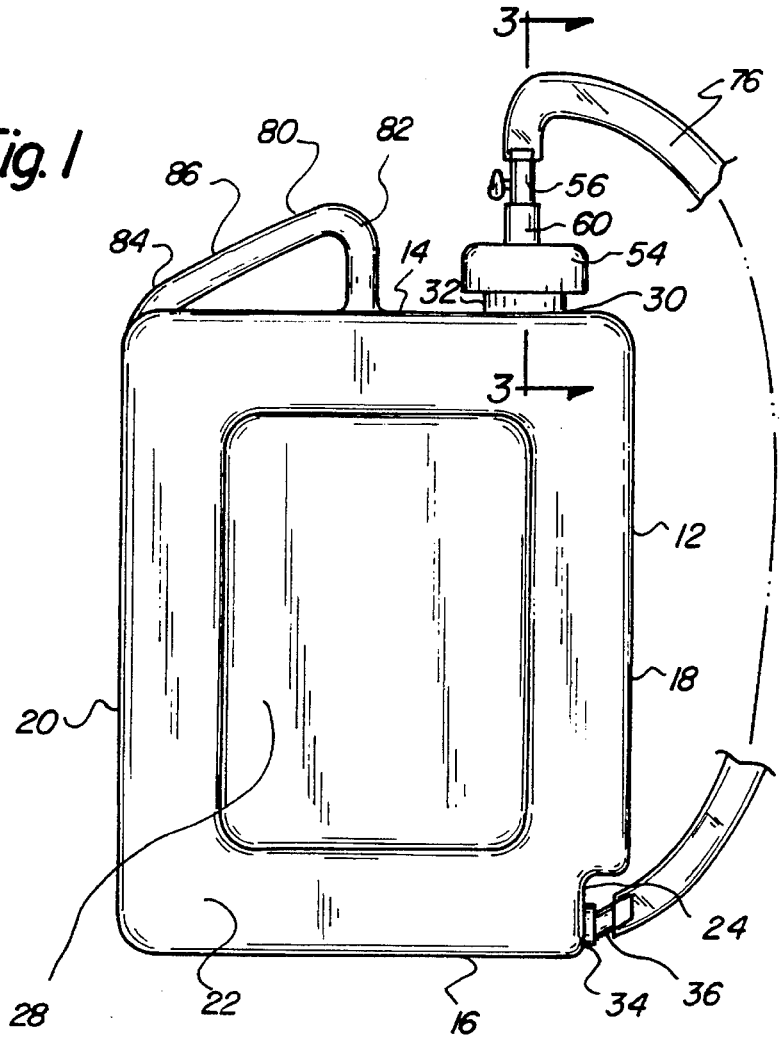
FIG. 1 is a perspective view of the preferred embodiment of the small engine fluid dispensing containers constructed in accordance with the principles of the present invention
Figure 2:
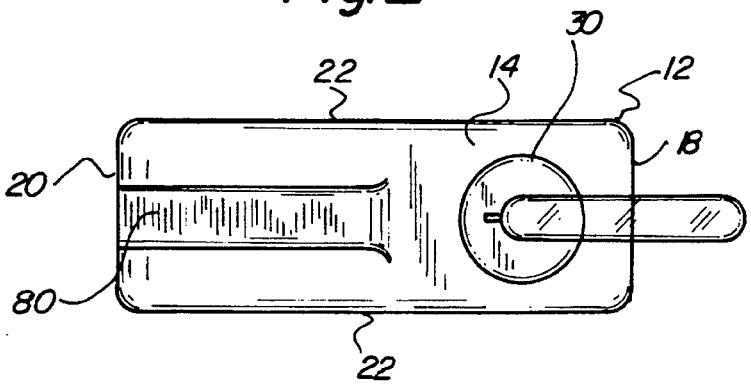
FIG. 2 is a top plan view of the apparatus shown in FIG. 1.
Figure 3:
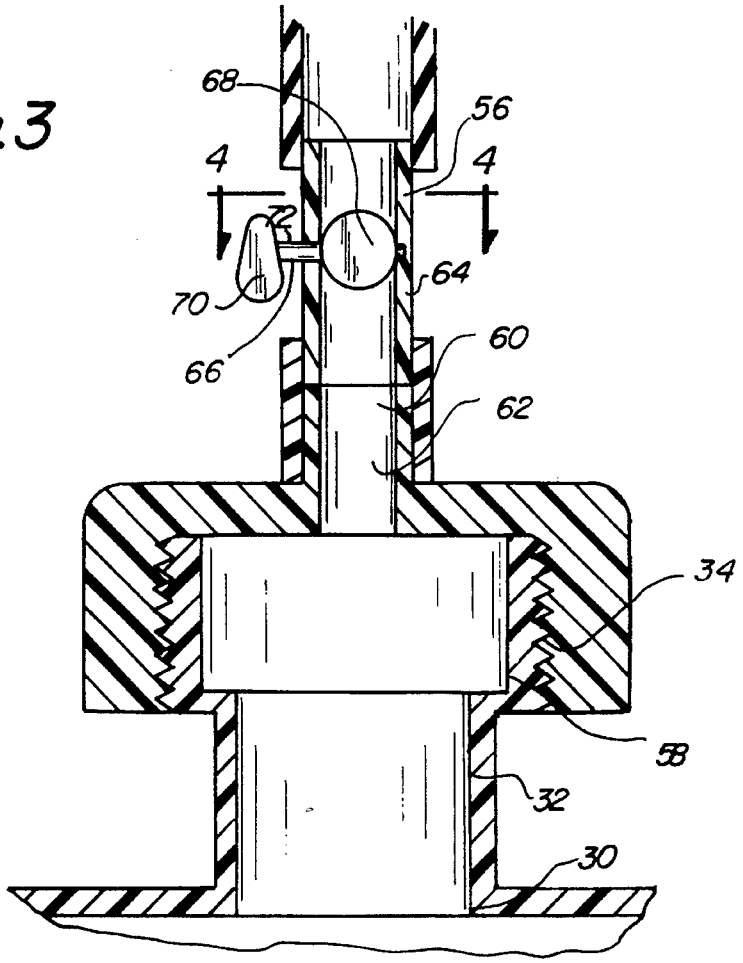
FIG. 3 is a cross sectional view of the apparatus taken along line 3—3 of FIG. 1.
Figure 4:
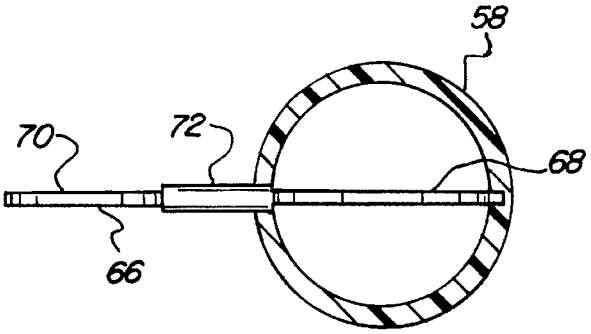
FIG. 4 is a cross sectional view of the valve taken along line 4—4 of FIG. 3.
Figure 5:
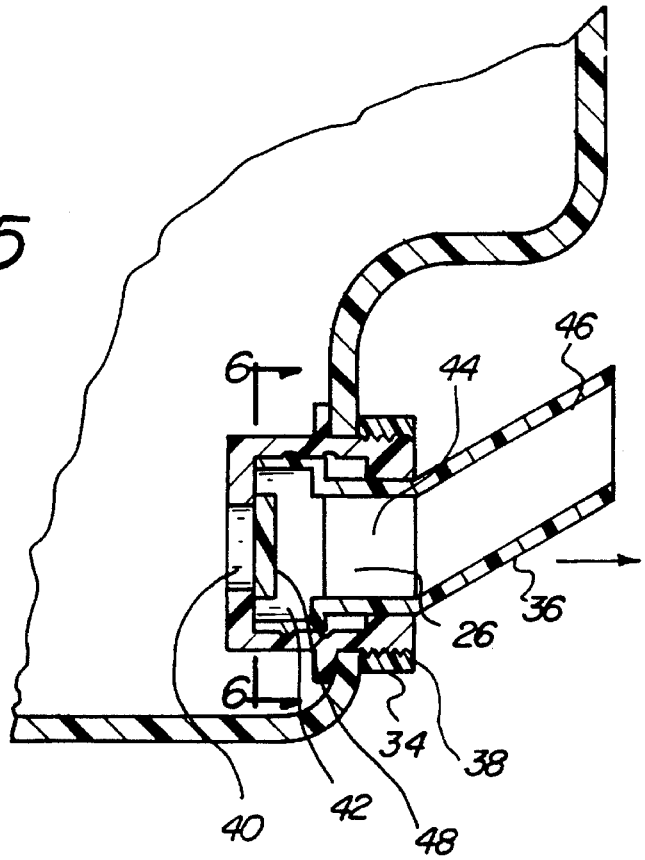
FIG. 5 is a broken away cross sectional view of the circular ring and spout components of the apparatus.
Figure 6:
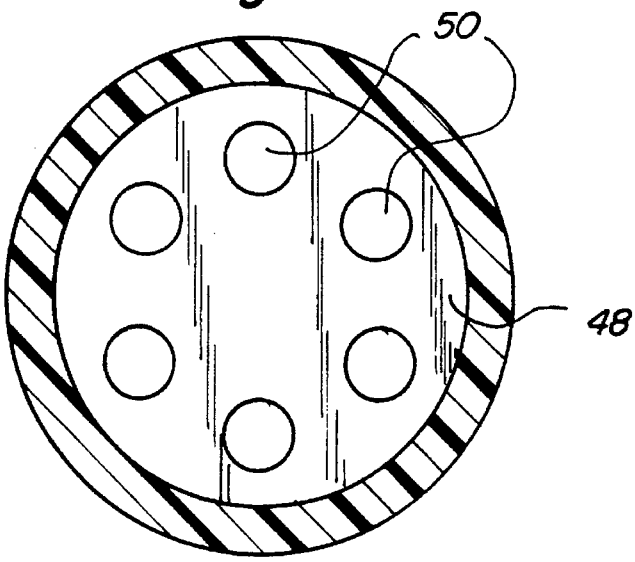
FIG. 6 is a cross sectional view of the spout taken along line 6—6 of FIG. 5 illustrating the plate and its circular holes.

With reference now to the drawings, and in particular to FIG. 1 thereof, the preferred embodiment of the new and improved small engine fluid dispensing containers embodying the principles and concepts of the present invention and generally designated by the reference numeral 10 will be described.

Specifically, it will be noted in FIGS. 1 through 8, that there is provided a new and improved small engine fluid dispensing containers. The small engine fluid dispensing container 10, in its broadest context, comprises a container 12, a circular ring 34, a spout 36., a fill cap 54, a valve 56, a hose 76 and a handle 80.

More specifically, the container 12 is fabricated of plastic and formed as a hollow generally rectangular shaped box. When empty the container is very light and easily transportable. The container 12 has a top wall 14, a bottom wall 16, a narrow front wall 18, a narrow back wall 20, and parallel wide side walls 22. All of the corners and edges of the container are rounded. The rounded configuration helps to prevent injury while manipulating the apparatus. The container 12 includes an inverted L-shaped recessed indentation 24 at the intersection of the front wall 18 and bottom wall 16. The vertical portion of the indentation 24 includes a centrally located circular hole 26 near the bottom wall. Note FIG. 5 in particular.

The central portion of the large side walls of the container include generally rectangular shaped indentations 28 to add strength to the apparatus. The top wall 14 includes a centrally positioned circular aperture 30 near the intersection of the front and top walls. The aperture 30 has a neck 32 which extends upwardly from its circumfrential edges. The neck 32 is formed in a generally cylindrical configuration and includes external screw threads 34 near its upper extent. This aperture is utilized by the user when filling the container or dispensing large quantities of fluid. Note FIGS. 1 and 3.

A circular ring 34 and spout 36 are included in the apparatus. The ring 34 is positioned around the periphery of the hole in the container. The ring 34 extends outwardly and includes external screw threads 38. The interior of the hole 26 includes a small centrally located aperture 40. The interior of the hole 26 has a slightly larger circumference than the circular opening in the ring 34. Fluid is dispensed through the spout when small to medium amounts of liquid are required. Note FIGS. 1 and 3.

The spout 36 is formed in a generally tubular configuration with an inner region 42, an outer region 44 and a middle region 46 therebetween. Note FIG. 5. The inner 42 and outer 44 regions have openings at both ends. The inner region 42 has a larger circumference than the other regions and is adapted to be positioned in the interior of the hole 26. The outer region 44 is angled upward and extends outside the hole 26. This upwardly angled orientation prevents spillage when dispensing is completed. The middle region 46 connects the inner 42 and outer regions 44 and is positioned within the opening in the ring 34. The open end of the inner region 42 has a circular planar plate 48 positioned within it. The inner region measures about one half the width of the hole. The plate 48 includes a plurality of circular holes 50 near its perimeter. The spout is adapted to allow the free flow of fluid therethrough when pulled outward by the user. In this orientation the aperture is unobstructed by the middle portion of the plate. The fluid flows through the aperture, through the circular holes in the plate and out the spout. When pushed inward, the inner portion of the plate 48 is thrust flush against the small aperture 40 in the hole 26 thereby blocking the aperture and preventing the flow of fluid therethrough. Note FIGS. 1 and 5.

A fill cap 54 and an associated valve 56 are included in the apparatus. The fill cap 54 is formed in a generally cylindrical configuration with an open bottom which includes a plurality of internal screw threads 58. The top is formed in a planar configuration with a centrally located hollow tube 60 extending upward therefrom. The top includes a hole 62 below the hollow interior of the tube 60. The cap 54 is securely coupled to the neck 32 in the operative orientation. The fill cap includes a small upper tube which is utilized to dispense small quantities of fluid. Note FIGS. 1 and 3.

The valve 56 includes a tubular component 64 with two open ends. The valve 56 also includes a regulator component 66 with a round planar end 68 located within the tubular component 64. The regulator component 66 has a generally triangular shaped handle 70 with rounded ends which is located outside of the tube 64. A thin axle 72 connects the round planar end 68 and handle therebetween 70. The valve 56 is adapted to regulate the flow of fluid therethrough upon turning of the handle by the user. The valve 56 is adapted to be positioned within the tube of the filler cap 54 in the operative orientation. The valve permits the user to dispense very small quantities of fluid when the regulator is turned to a semi closed position. Note FIGS. 3 and 4.

A hose 76 is formed in a hollow tubular configuration with two open ends. In one orientation, an end of the hose 76 in coupled with the free end of the valve 56 and the other end is positionable in the tank of a small engine. This orientation is used when dispensing minute quantities of fluid. In another orientation, an end of the hose 76 is coupled with the free end of the spout 36 and the other end is positionable in the tank of a small engine. This orientation is used when dispensing small to medium quantities of fluid. Both free ends of the hose 76 are coupled with the valve 56 and spout 36 in the inoperative orientation. This orientation helps prevent leakage during storage and transportation of the apparatus. Note FIG. 1.

A handle 80 has one end 82 which extends upwardly a short distance from the top wall 14 of the container. The other end 84 of the handle is formed contiguously with the rounded intersection of the top 14 and back walls 20. The remainder of the handle 86 is positioned in an angled orientation therebetween. The handle is constructed of sturdy solid plastic and permits the user to carry, tilt and pour the apparatus even when completely filled with fluid. Note FIGS. 1 and 2.

Figure 7:
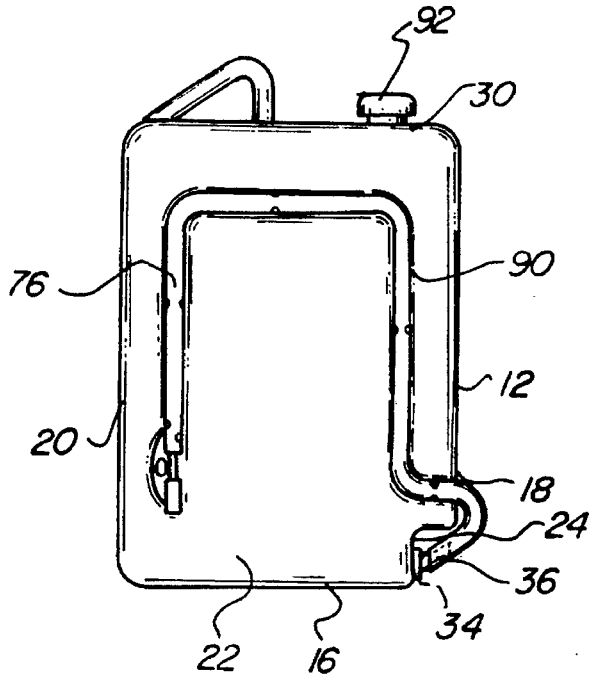
FIG. 7 is a side elevational view of an alternative embodiment of the apparatus with the hose mounted in the groove in the side wall.
Figure 8:
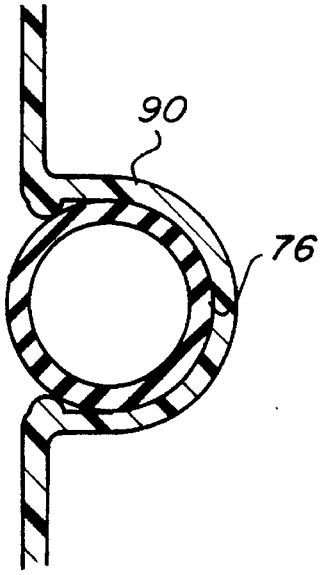
FIG. 8 is a cross sectional view of the alternative embodiment taken along line 8—8 of FIG. 7.

An alternative embodiment of the invention is shown in FIGS. 7 and 8. In such embodiment, one of the side walls of the container includes a generally semi circular concave groove 90 adapted the support a hose therein. When the apparatus is not in use the hose 76 and valve 56 may be stored in the groove. A planar cap 92 is utilized in conjunction with this embodiment of the invention. The planar top section of the cap is completely closed so as to prevent evaporation of stored fluid therethrough. This embodiment is primarily for long term storage of the fluid contained within the apparatus.

The adjacent end of hose 76 is preferably coupled to spout 36 at all times. In this manner, the contained liquid will not spill as during storage in the event that the spout should open up accidentally.

The small engine fluid dispensing container is designed to dispense fluid into small engines. It is made of plastic and constructed like a conventional container, except that a clear flexible hose is attachable to a spout near the bottom of the container, or a fill cap at the top of the container. A small valve is coupled to the fill cap and is adapted to regulate the flow of fluid therethrough. The valve is actuated by a small handle located outside of the valve.

One need only remove the sealing cap and elevate the container to dispense as much or as little of a fluid as desired. In this fashion, one can satisfy the specific requirement for a given fluid level on any small engine, and it will not be necessary to discard or seal the remainder of fluid in a standard container, such as those made in quart and gallon sizes. Further, the need for a funnel is completely eliminated.

The small engine fluid dispensing container can also be made in an alternative embodiment featuring a separate sealing cap which has a contoured recess in one of its sides to store the hose. This embodiment may be better for use in situations where the fluid is to be stored for an extended period of time since the separate cap positively seals the contents from contact with air. However, the intended purpose of the apparatus is to easily satisfy the variable fluid requirements for small engines, and either embodiment serves this purpose well.

Small engines require very little oil and frequently have small gas tanks. Additional units of the apparatus can be used to dispense many different types of fluids while conserving the remainder for future use. It would be a valuable acquisition for anyone owning a lawn mower, weed trimmer, snow thrower, or any other power tool or conveyance with a small engine.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved small engine fluid dispensing container comprising, in combination:

a container fabricated of plastic and formed as a hollow generally rectangular shaped box including a top wall, a bottom wall, a narrow front wall, a narrow back wall, and parallel wide side walls, with all of the corners and edges of the container being rounded, with the container including an inverted L-shaped recessed indentation at the intersection of the front wall and bottom wall, the vertical portion of the indentation including a centrally located circular hole near the bottom wall, the central portions of the large side walls of the container including generally rectangular shaped indentations to add strength to the apparatus, the top wall including a centrally positioned circular aperture near the intersection of the front and top walls, the aperture having a neck extending upwardly from its circumferencial edges, the neck being formed in a generally cylindrical configuration and including external screw threads near its upper extent;

a circular ring and spout, the ring being positioned around the periphery of the hole in the container, the ring extending outwardly and including external screw threads, with the interior of the hole including a small centrally located aperture, with the interior of the hole having a slightly larger circumference than the circular opening in the ring, the spout being formed in a generally tubular configuration with an inner region, an outer region and a middle region therebetween, the inner and outer regions having openings at both ends, the inner region having a larger circumference than the other regions and adapted to be positioned in the interior of the hole, with the outer region angled upward and extending outside the hole, the middle region connecting the inner and outer regions and positioned within the opening in the ring, the open end of the inner region having a circular planar plate positioned within, the plate including a plurality of circular holes near its perimeter, the apparatus adapted to allow the free flow of fluid therethrough when pulled outward by the user, when pushed inward the inner portion of the plate is positioned flush against the small aperture in the hole thereby preventing the flow of fluid;

a fill cap and an associated valve, the fill cap being formed in a generally cylindrical configuration with an open bottom including a plurality of internal screw threads, the top formed in a planar configuration with a centrally located hollow tube extending upward therefrom, with the top having a hole below the hollow interior of the tube, the cap being securely coupled to the neck when operating the dispenser, the valve including a tubular component with two open ends, the valve including a regulator component with a round planar end located within the tubular component, the regulator component having a generally triangular shaped handle with rounded ends located outside the tube, with a thin axle connecting the round planar end and handle therebetween, the valve adapted to regulate the flow of fluid therethrough upon turning of the handle by the user, the valve adapted to be positioned within the tube of the filler cap;

a hose, the hose being formed in a hollow tubular configuration with two open ends, in one orientation an end of the hose being coupled with the free end of the valve assembly with the other end positionable in the tank of a small engine, in a second orientation, an end of the hose being coupled with the free end of the spout with the other end positionable in the tank of a small engine, in a third orientation the free ends of the hose being coupled to the valve assembly and spout respectively; and a handle, the handle having one end extending upwardly a short distance from the top wall of the container, with the other end formed contiguously with the rounded intersection of the top and back walls, the remainder of the handle being positioned in an angled orientation therebetween.

2. A small engine fluid dispensing container comprising:

a container formed as a hollow generally rectangular shaped box with a top wall, a bottom wall, and side walls, the top wall including a circular aperture with a neck extending upwardly from its circumferencial edges, one of the side walls including an upwardly angled spout for controlled dispensing of fluid, a hose being coupled to the spout a fill cap including coupling means being securely coupled upon the neck, the fill cad being formed in a generally cylindrical configuration with an open bottom and a planar top having a circular aperture, the top including a tube with open ends extending upwardly from the circumference of the aperture, the tube including a valve positioned therein to regulate the flow of fluid therethrough upon turning by the user.

3. The apparatus as set forth in claim 2 and further including:

said hose formed in a hollow tubular configuration with two open ends, in a first orientation an end of the hose being coupled to the tube of the filler cap with the other end being positionable in the tank of a small engine, in a second orientation an end of the hose being coupled to the spout with the other end being positionable in the tank of a small engine, in a third orientation an end of the hose being coupled to the tube of the filler cap and the other end being coupled to the spout.

4. The apparatus as set forth in claim 3 wherein a side wall of the container includes a generally semi circular concave groove adapted to support the hose therein.

5. The apparatus as set forth in claim 2 wherein the side walls of the container include generally rectangular shaped indentations in their central regions to add strength to the apparatus.

6. The apparatus as set forth in claim 2 and further including:

a handle extending upwardly from the top wall of the container, the handle adapted to be grasped by a user when carrying the container.

* * * * *